US005107238A

United States Patent [19]

Leupold

[11] Patent Number: 5,107,238

[45] Date of Patent: Apr. 21, 1992

[54] MAGNETIC CLADDING FOR USE IN PERIODIC PERMANENT MAGNET STACKS

[75] Inventor: Herbert A. Leupold, Eatontown, N.J.

[73] Assignee: The United States of America as represented by the Secretary of the Army, Washington, D.C.

[21] Appl. No.: 677,897

[22] Filed: Apr. 1, 1991

[51] Int. Cl.[5] ..... H01F 7/02

[52] U.S. Cl. ..... 335/306; 335/304; 335/210; 335/211; 335/214; 315/5.35

[58] Field of Search ..... 335/209, 210, 211, 212, 335/214, 296, 297, 298, 301, 302, 304, 306; 250/396 ML; 315/5.34, 5.35

[56] References Cited

U.S. PATENT DOCUMENTS 3,205,415 12/1962 Seki et al. ..... 335/210
4,731,598 3/1988 Clarke ..... 335/210
4,829,276 5/1989 Leupold et al. ..... 335/306
5,014,028 5/1991 Leupold ..... 335/210
5,019,863 5/1991 Quimby ..... 335/210

*Primary Examiner*—Leo P. Picard
*Assistant Examiner*—Ramon M. Barrera
*Attorney, Agent, or Firm*—Michael Zelenka; William H. Anderson

[57] ABSTRACT

Periodic permanent magnet (PPM) stacks for use in wigglers and traveling wave tubes having magnetic cladding. A variable magnetic potential cladding along the adjacent surfaces of working magnets is used, thereby increasing the efficient use of magnetic material and increasing the magnetic field while minimizing weight. The magnetic cladding has a direction of polarity perpendicular to the direction of polarity of the working magnets. Extraneous magnetic fields are also reduced. A magnetic shunt, or soft iron, is used to facilitate the conduction of magnetic flux and create an equal magnetic potential exterior surface.

12 Claims, 2 Drawing Sheets

MAGNETIC CLADDING FOR USE IN PERIODIC PERMANENT MAGNET STACKS

GOVERNMENT INTEREST

The invention described herein may be manufactured, used and licensed by or for the government for governmental purposes without the payment to me of any royalty thereon.

FIELD OF THE INVENTION

This invention relates generally to magnetic cladding to reduce magnetic flux leakage and provide an enhanced magnetic field, and more specifically to a magnetic cladding applied to periodic permanent magnet (PPM) stacks as used in wiggler and traveling wave tubes.

BACKGROUND OF THE INVENTION

Various magnetic devices, such as klystrons, traveling wave tubes, microwave devices, and other magnetic circuits, have employed magnetic cladding to help intensify the desired working magnetic field, as well as to reduce the external affects of the magnetic device due to leakage of magnetic flux.

For example, U.S. Pat. No. 3,768,054 entitled "Low Flux Leakage Magnetic Construction" issuing to Neugebauer discloses a number of magnetic circuits, each having a magnetic cladding thereon. These various cladding devices produce cladding circuits that reduce the exterior magnetic flux leakage and increase the desired working magnetic field intensity without appreciably increasing the size or weight of the magnetic circuit. Another example of magnetic cladding used in magnetic circuits is disclosed in U.S. Pat. No. 4,647,887 entitled "Lightweight Cladding for Magnetic Circuits" issuing to Herbert A. Leupold, the same inventor as the present invention, on Mar. 3, 1987. Therein disclosed is a magnetic cladding device having an exterior magnetic potential equal to a magnetic potential at a point between either end of an active magnet. The axial magnetic field of a cylindrical device is thereby enhanced.

While these prior art devices show in general the use of magnetic cladding for magnetic circuits, and therefore have served their purpose, they are not applicable to other specialized magnetic circuits having different requirements.

SUMMARY OF THE INVENTION

The present invention is directed to a periodic permanent magnet (PPM) stack that will cause an electron to "wiggle" when passing through a gap formed by the PPM stack, and to traveling wave tubes (TWT) having a reversing longitudinal working magnetic field. Cladding magnets are positioned between the alternating periodic permanent magnets. These cladding magnets have a varying magnetic potential. The orientation of the cladding magnets is such to facilitate the magnitude of the working magnetic field formed within the gap. The varying magnetic potential cladding magnet can be formed either geometrically with a magnet having a triangular cross-section, or by a magnet having a rectangular cross-section that is variably magnetized to create the variable magnetic potential.

In one embodiment of the present invention, a magnetic shunt is placed on the exterior surface of the PPM stack. This magnetic shunt conducts flux along the exterior surface, enhancing the magnetic field within the gap and forming an equal magnetic potential surface along the exterior of the magnetic circuit. The equal magnetic potential surface lessens magnetic flux leakage.

Therefore, it is an object of the present invention to increase the working field strength in a PPM stack. It is an advantage of the present invention that a reduction of weight and an increase in working magnetic field can be achieved.

It is a further advantage of the present invention that the stronger magnetic field can be achieved with a smaller size magnetic circuit.

It is a feature of the present invention that a cross-section of the cladding magnets is triangular in shape.

It is another feature of the present invention that a magnetic shunt is used to facilitate magnetic flux conduction along the exterior surface of the PPM stack.

These and other objects, advantages, and features will become more readily apparent in view of the following more detailed description.

DETAILED DESCRIPTION OF THE PREFERRED EMBODIMENTS

Figure 1:
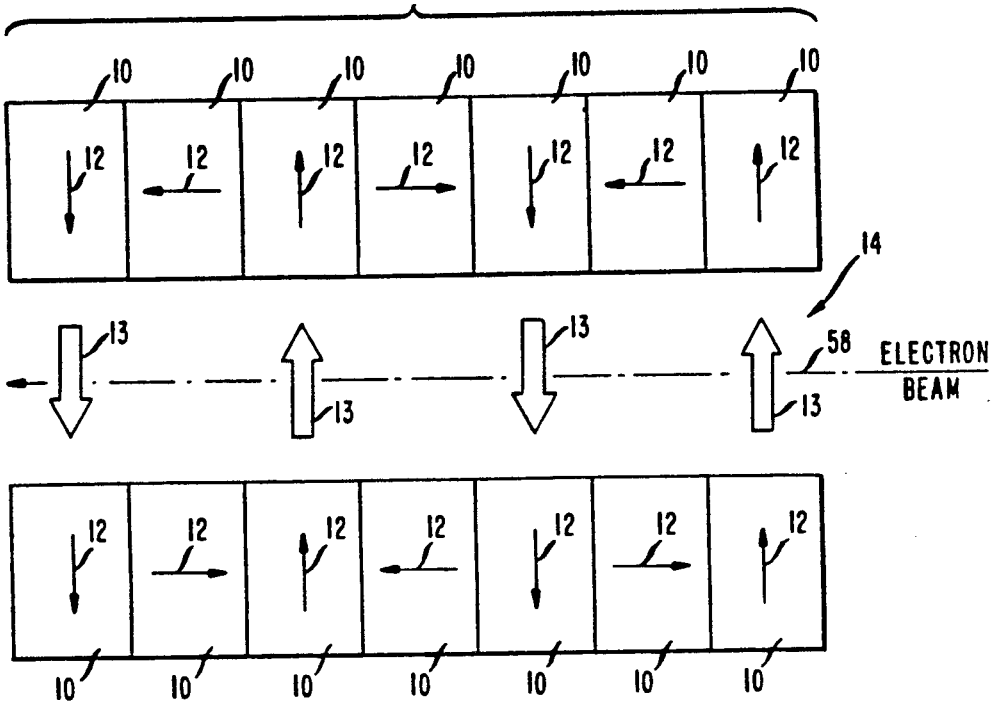
FIG. 1 (PRIOR ART)
FIG. 1 illustrates a prior art PPM stack in longitudinal cross section.

FIG. 1 illustrates a prior art periodic permanent magnet (PPM) stack. The PPM stack illustrated in FIG. 1 forms a tube 4 having any desired lateral cross-section, typically circular or rectangular. A plurality of permanent magnets 10 having varying orthogonal magnetic polarity directions are assembled adjacent each other in a stack A gap is formed between the top stack and the bottom stack. Within the gap 14 is a magnetic field that extends from the top interior surface to the bottom interior surface. The direction of the magnetic field alternates in direction longitudinally from one end to the other of the PPM stack. On each permanent magnet 10 of the PPM stack is an arrow 12. Arrows 12 represent the direction of magnetic polarity of each magnet 10. The head of the arrow points in the magnetic north direction. From viewing this prior art device, the magnetic field created by the PPM stack can readily be appreciated. Starting from the left hand side, the magnetic field will traverse the gap from the interior top surface downward into the interior bottom surface of the first magnet in the stack. The second magnet, proceeding to the right from the left, facilitates the magnetic field entering into the third permanent magnet in the PPM stack from which the magnetic field crosses gap 14 from the bottom interior surface to the top interior surface. The direction of the magnetic field continues to alternate from pointing up to pointing down within the gap 14 to the other end of the PPM stack. This working magnetic field is represented by outline arrows 13. Therefore, when an electron beam represented by arrow 58 is directed through the longitudinal gap formed by the PPM stack, the electron beam 58 will interact with the magnetic field causing the electron beam 58 to wiggle in a plane perpendicular to the magnetic field. Hence, this type of PPM stack is designated a wiggler.

Figure 2:
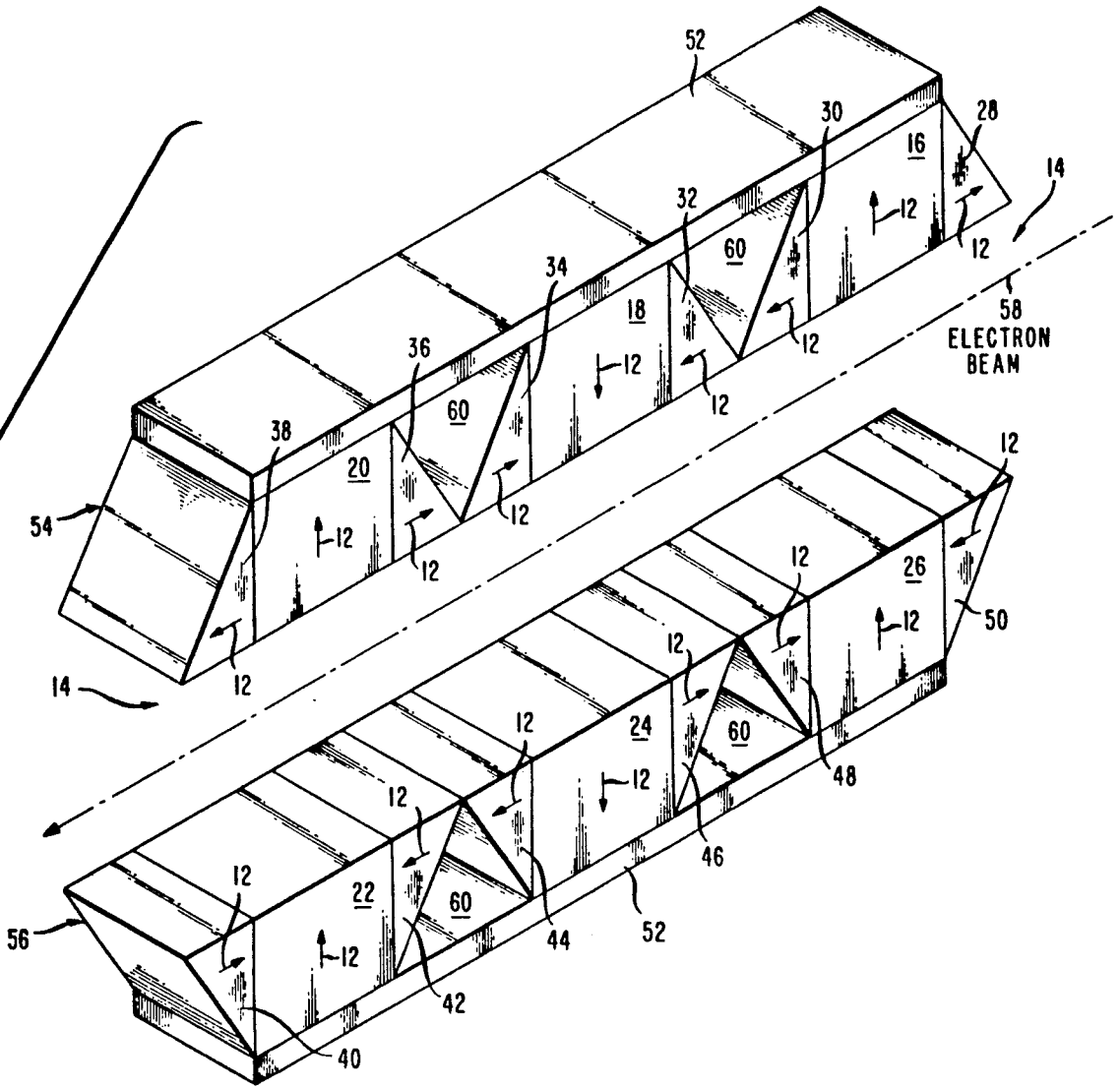
FIG. 2 is a perspective view illustrating an embodiment of the present invention applied to a "wiggler" PPM stack.

FIG. 2 illustrates the present invention, which is an improvement over the prior art device illustrated in FIG. 1. FIG. 2 illustrates a cladded PPM stack having permanent magnets 16, 18, and 20 in a top magnetic stack 54 and permanent magnets 22, 24, and 26 in a bottom magnetic stack 56. This top magnetic stack 54 and bottom magnetic stack 56, the working permanent magnets, form a gap 14 therebetween. The working permanent magnets 16, 18, 20, 22, 24 and 26 have a magnetic orientation that is perpendicular to the longitudinal axis of the gap 14 and a direction illustrated by arrows 12 thereon. The plurality of working permanent magnets 16, 18, 20, 22, 24 and 26, have positioned on either side thereof a plurality of pairs of cladding permanent magnets 28, 30, 32, 34, 36, 38, 40, 42, 44, 46, 48 and 50. The plurality of pairs of cladding permanent magnets 28, 30, 32, 34, 36, 38, 40, 42, 44, 46, 48 and 50 have a magnetic polarity in a direction perpendicular to the direction of the magnetic polarity of the plurality of working permanent magnets 16, 18, 20, 22, 24, 26. The direction of magnetic polarity is illustrated on the cladding permanent magnets 28, 30, 32, 34, 36, 38, 40, 42, 44, 46, 48 and 50 by arrows 12. Between each of the working permanent magnets 16, 18, 20, 22, 24, 26, along the exterior edge thereof, is a space 60. The spaces 60, in both the top magnetic stack 54 and the bottom magnetic stack 56, are bridged by a magnetic shunt 52. Magnetic shunt 52 can be made of any material that readily conducts magnetic flux and has a high magnetic saturation point, such as soft iron.

The operation of the present invention can readily be appreciated with reference to FIG. 2. An electron beam represented by arrow 58, upon entering the gap 14 from the right and proceeding left, will first encounter a magnetic field in an upward direction emanating from the surface of magnet 26 across gap 14 and entering the surface of magnet 16. The magnetic field generated by magnet 26 is constrained by cladding magnets 48 and 50. The direction of polarity of cladding magnets 48 and 50 is illustrated by arrows 12 thereon. The magnetic flux of magnet 26 emanates from one pole and returns to the other. Only a portion of this magnetic flux within the working gap 14 is useful. The magnetic flux outside this working gap 14 is considered leakage. To prevent this leakage it is necessary that all points on the surface of the magnet 26, with the exception of the pole adjacent the working gap 14, be at the same magnetic potential. Therefore, if a reference potential is taken at the surface of the magnetic shunt 52, the surface of magnet 26 must have a magnetic potential on all sides equal to this reference potential in order to prevent magnetic flux leakage. This is accomplished with the use of cladding magnets 48 and 50 placed adjacent the side surfaces of magnet 26. The cladding magnets 48 and 50 must have a change in potential from the surface adjacent magnet 26 to the outside surface of the cladding magnet equal and opposite to the change in potential from the reference potential and a point along the side of magnet 26 which is to be cladded. The magnetic potential along the side of magnet 26 is equal to the flux flowing through the magnet multiplied by the internal reluctance over the portion of the path. Therefore, the magnetic potential adjacent a point along the side surface of magnet 26 can be made equal and opposite to the magnetic potential from the reference potential to the point along the side surface of magnet 26 by placing a cladding magnet adjacent thereto. The thickness of the cladding magnet will depend upon the potential required and the coercivity of the magnetic material. The magnetic potential along the side of the magnet 6 from the reference potential increases linearly assuming the magnet 26 is homogeneous. Therefore, the cross section of cladding magnets 48 and 50 is triangular as illustrated.

The working magnetic field within gap 14 is increased and substantially confined to the exposed interior pole surface of magnet 26 adjacent gap 14. Similarly, the magnetic field in the interior pole surface opposite magnet 26 is increased and confined, but of opposite polarity. Therefore, the magnetic polarity of cladding magnets 30 and 28 is in a direction opposite to that of cladding magnets 48 and 50. Similarly, as the opposite polarity of magnet 16 decreases, the magnetic potential of cladding magnets 46 and 30 equally decreases, thereby confining the magnetic field to the exposed interior pole surface within gap 14 of magnet 16. The magnetic field can then freely traverse space 60 through magnetic shunt 52 and into magnet 18. Magnet 18 is cladded by cladding magnets 32 and 34 similarly to magnet 26 previously discussed. Analogously, magnet 24 is cladded similarly to magnet 16 as also previously discussed. However, in this instance, the magnetic field created within gap 14 between the interior pole surfaces of magnets 18 and 24 flow in a direction opposite to that of the magnetic field created by magnets 16 and 28. This alternating magnetic field direction between adjacent working magnets continues for however many pairs of working magnets are desired in view of the specific application.

Figure 3:
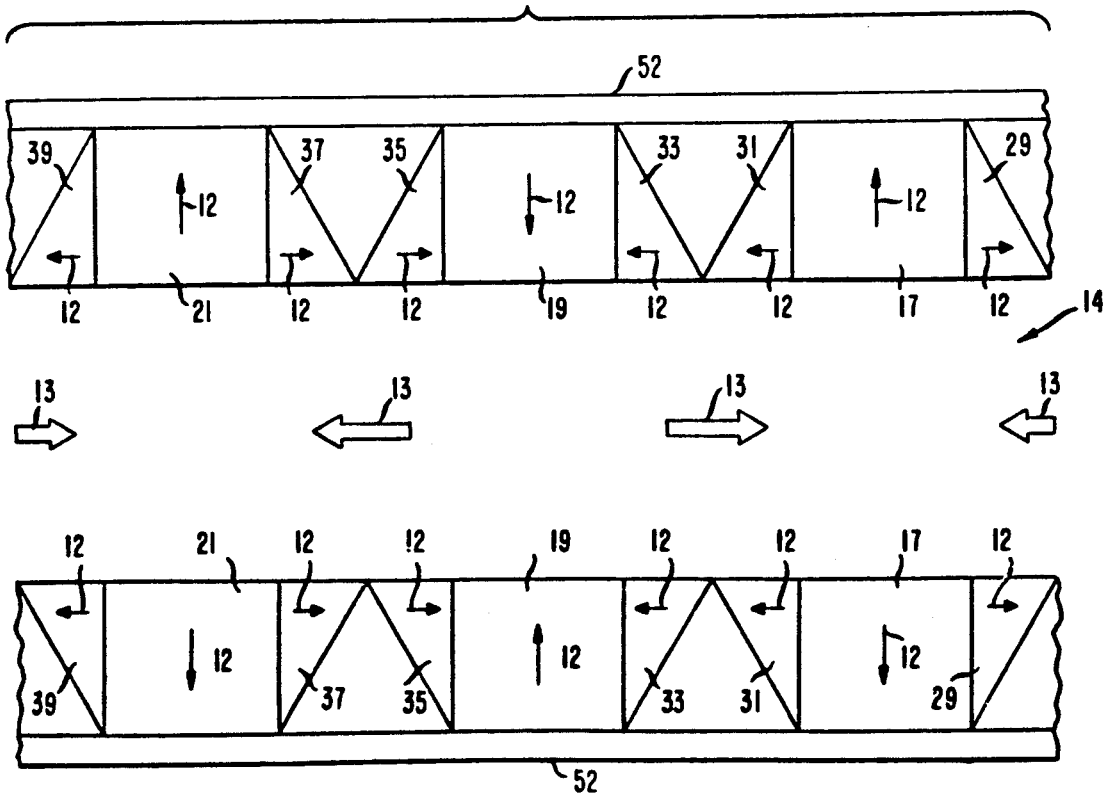
FIG. 3 is a longitudinal cross section of another embodiment of the present invention applied to a traveling wave tube PPM stack.

FIG. 3 illustrates another embodiment of the present invention. In FIG. 3, the present invention is applied to a traveling wave tube (TWT) structure. In the traveling wave tube structure, the direction of the working magnetic field is illustrated as outlined arrows 13. This working magnetic field is directed in a substantially longitudinal direction to the bore 14, and alternates in direction. This is caused by the magnetic orientation of the annular radially magnetized working magnets 17, 19, and 21. The annular radially magnetized working magnets, 17, 19 and 21, have a magnetic orientation as indicated by arrows 12, the head of the arrow representing magnetic north. Therefore, as can be seen in FIG. 3, the magnetic south portion of magnet 17 is adjacent the interior bore 14. This, in combination with the radial working magnet 19 having their north pole adjacent the interior bore 14, creates a working magnetic field in a direction as indicated by the outline arrow 13, which is substantially in a direction longitudinal to the bore 14. As can be seen by the periodic nature of the radial magnets 17, 19, and 21 the direction of the working magnetic field, as represented by outline arrows 13, will alternate longitudinally as indicated. The working magnets are cladded by the longitudinally polarized, annular cladding magnets 29, 31, 33, 35, 37, and 39. These cladding magnets are similar to those discussed in FIG. 2, except that the magnets are annular in shape. These longitudinally polarized cladding magnets 29, 31, 33, 35, 37, and 39, have a magnetic orientation to reduce the magnetic flux leakage of the radial working magnets 17, 19, and 21. Therefore, the teachings of the present invention are readily applied to a TWT structure.

In view of the above, it can readily be appreciated that the present invention provides a more efficient us of magnetic material than previously possible. The cladding magnets are used only to provide the necessary magnetic potential to confine the desired magnetic field. This saves expensive magnetic material, and weight. Additionally, the inefficiencies resulting from the magnetic field paths in the prior art PPM stack are avoided by the addition of a magnetic shunt along the exterior top and bottom surfaces of the present invention as embodied in the wiggler structure, and the entire circumference in the TWT structure.

If desired, the cladding magnets of the present invention can be made of a material that can be variably magnetized to provide the varying magnetic potential as desired. In some applications, this may be desirable to facilitate assembly. In most applications, the magnetic potential along the surface of the cladding magnets will vary linearly.

Although the preferred embodiment has been illustrated and described, it will be obvious to those skilled in the art that various modifications may be made without departing from the spirit and scope of this invention.

What is claimed is:

1. A magnetic circuit comprising:

a plurality of working permanent magnets having a gap formed therebetween, said plurality of magnets having a magnetic orientation perpendicular to an axis extending longitudinally along said gap, said plurality of magnets arranged with alternating polarity to create a reversing transverse magnetic field in said gap along the axis, each working magnet having a rectangular cross-section in the direction of magnetic orientation; and a plurality of adjacent pairs of cladding permanent magnets, each pair having one of said plurality of working permanent magnets positioned therebetween, said plurality of pairs of cladding permanent magnets each having a magnetic orientation transverse to the magnetic orientation of said plurality of working permanent magnets, and a magnetic potential that varies linearly from a higher magnetic potential near the gap to an decreasing lower magnetic potential as a distance from the gap increases, said plurality of pairs of cladding permanent magnets each further having a triangular cross-section in a plane of the direction of their magnetic orientation such that a triangular space is formed between adjacent pairs of cladding permanent magnets.

2. A magnetic circuit comprising:

a plurality of working permanent magnets having a gap formed therebetween, said plurality of magnets having a magnetic orientation perpendicular to an axis extending longitudinally along said gap, said plurality of magnets arranged with alternating polarity to create a reversing transverse magnetic field in said gap along the axis, each working magnet having a rectangular cross-section in the direction of magnetic orientation; and a plurality of adjacent pairs of cladding permanent magnets, each pair having one of said plurality of working permanent magnets positioned therebetween, said plurality of pairs of cladding permanent magnets each having a magnetic orientation transverse to the magnetic orientation of said plurality of working permanent magnets, and a magnetic potential that varies linearly from a higher magnetic potential near the gap to an decreasingly lower magnetic potential as a distance from the gap increases, said plurally of pairs of cladding permanent magnets each further having a rectangular cross-section taken in the plane of the direction of magnetic orientation, whereby each of said plurality of pairs of cladding magnets is not uniformly magnetized.

3. A magnetic circuit as in claim 1 further comprising:

a magnetic shunt placed on the external surface of each said plurality of working magnets on the end opposite said gap whereby a constant magnetic potential is obtained on the surface of said shunt.

4. A magnetic circuit as in claim 3 wherein: said magnet shunt is made of soft iron.

5. A magnetic circuit comprising:

a plurality of toroidal working permanent magnets forming a working space therethrough, said plurality of magnets having a radial magnetic orientation perpendicular to an axis extending longitudinally along said working space, said plurality of magnets arranged with alternating polarity to create a reversing transverse magnetic field in said working space along the axis, each working magnet having a rectangular cross-section in the direction of magnetic orientation; and a plurality of adjacent pairs of toroidal cladding permanent magnets, each pair having one of said plurality of working permanent magnets positioned therebetween, said plurality of pairs of cladding permanent magnets each having an axial magnetic orientation transverse to the magnetic orientation of said plurality of working permanent magnets, and a magnetic potential that varies linearly from a higher magnetic potential near the working space to an decreasingly lower magnetic potential as a distance from the working space increases, each said plurality of pairs of cladding permanent magnets each further having a triangular cross-section in a plane of the direction of their magnetic orientation such that a triangular space is formed between adjacent pairs of cladding permanent magnets.

6. A magnetic circuit comprising:

a plurality of toroidal working permanent magnets forming a working space therethrough, said plurality of magnets having a magnetic orientation perpendicular to an axis extending longitudinally along said working space, said plurality of magnets arranged with alternating polarity to create a reversing transverse magnetic field in said working space along the axis, each working magnet having a rectangular cross-section in the direction of magnetic orientation; and a plurality of adjacent pairs of toroidal cladding permanent magnets, each pair having one of said plurality of working permanent magnets positioned therebetween, said plurality of pairs of cladding permanent magnets each having a magnetic orientation transverse to the magnetic orientation of said plurality of working permanent magnets, and a magnetic potential that varies linearly from a higher magnetic potential near the working space to an decreasingly lower magnetic potential as a distance from the working space increases, said plurality of pairs of cladding permanent magnets each further having a rectangular cross-section taken in the plane of the direction of magnetic orientation, whereby each of said plurality of paris of cladding magnets is not uniformly magnetized.

7. A magnetic circuit as in claim 5 further comprising:

a cylindrical magnetic shunt placed on the external surface of each said plurality of working magnets whereby a constant magnetic potential is obtained on the surface of said shunt.

8. A magnetic circuit as in claim 7 wherein:

said magnetic shunt is made of soft iron.

9. A magnetic circuit as in claim 2 further comprising:

a magnetic shunt placed on the external surface of each said plurality of working magnets on the end opposite said gap whereby a constant magnetic potential is obtained on the surface of said shunt.

10. A magnetic circuit as in claim 9 wherein said magnetic shunt is made of soft iron.

11. A magnetic circuit as in claim 6 further comprising:

a cylindrical magnetic shunt placed on the external surface of each said plurality of working magnets whereby a constant magnetic potential is obtained on the surface of said shunt.

12. A magnetic circuit as in claim 11 wherein said magnetic shunt is made of soft iron.

* * * * *